US010517342B2

(12) United States Patent
Avery

(10) Patent No.: US 10,517,342 B2
(45) Date of Patent: Dec. 31, 2019

(54) SHOCK ABSORBING CAP

(71) Applicant: The CtFOT Group LLC, Teaneck, NJ (US)

(72) Inventor: Donna L. Avery, Teaneck, NJ (US)

(73) Assignee: THE CTFOT GROUP LLC, Teaneck, NJ (US)

( * ) Notice: Subject to any disclaimer, the term of this patent is extended or adjusted under 35 U.S.C. 154(b) by 0 days.

(21) Appl. No.: 15/358,017

(22) Filed: Nov. 21, 2016

(65) Prior Publication Data

US 2017/0143066 A1 May 25, 2017

Related U.S. Application Data

(60) Provisional application No. 62/260,179, filed on Nov. 25, 2015.

(51) Int. Cl.

| | |
|---|---|
| ***A42B 1/08*** | (2006.01) |
| ***A42C 1/00*** | (2006.01) |
| ***A63B 71/10*** | (2006.01) |
| ***A42B 3/10*** | (2006.01) |

(52) U.S. Cl.

CPC ..... *A42B 1/08* (2013.01); *A42B 3/10* (2013.01); *A42C 1/00* (2013.01); *A63B 71/10* (2013.01); *A63B 2243/007* (2013.01)

(58) Field of Classification Search

CPC ..... A42B 1/08; A42C 1/02
USPC ..... 2/412
See application file for complete search history.

(56) References Cited

U.S. PATENT DOCUMENTS

| | | | | | |
|---|---|---|---|---|---|
| 1,487,860 | A | * | 3/1924 | Kalbach | D04G 3/00 87/7 |
| 3,205,508 | A | * | 9/1965 | Cox | A42B 3/105 2/172 |
| 4,619,003 | A | * | 10/1986 | Asbury | A42B 3/12 2/412 |
| 4,809,690 | A | * | 3/1989 | Bouyssi | A42B 1/08 128/857 |
| 4,949,404 | A | * | 8/1990 | Fekete, Sr. | A42B 1/041 2/410 |
| 5,056,162 | A | * | 10/1991 | Tirums | A42B 3/125 2/412 |
| 5,259,071 | A | * | 11/1993 | Scott | A42B 3/122 2/410 |
| 5,272,000 | A | * | 12/1993 | Chenoweth | D04H 1/60 442/35 |

(Continued)

*Primary Examiner* — Anne M Kozak
(74) *Attorney, Agent, or Firm* — Leason Ellis LLP

(57) ABSTRACT

A structure, e.g., a shock absorbing cap, provides additional force or shock abortion between the interior of a traditional safety helmet and the head of the wearer. As a result, there is no need to change the helmets currently in use today. The cap has a first region, which is next to the scalp and is typically made of 100% knitted cotton. A second region is typically made of 100% wool fleece braided fiber bundles or locks that extend alternately in longitudinal and lateral directions. A sufficient number of layers of the knitted cotton bundles is provided to principally fill the gap between the head of each wearer and the interior of the helmet. This layer is the main shock absorbing element. The outermost region is typically made of one or more layers of braided 100% carbon fiber bundles, which run the opposite direction of the last wool lock. This carbon fiber bundle region helps to retain the structure of the cape. Every two layers in the cap are interlocked with the other layers on either side, except that the interlocking stops with the top carbon layer.

7 Claims, 5 Drawing Sheets

(56) References Cited

U.S. PATENT DOCUMENTS 5,630,230 A * 5/1997 Fujino ..... A41D 20/005 2/200.1
5,887,285 A * 3/1999 McCormick ..... A42C 5/04 2/171.1
6,112,332 A * 9/2000 McCormick ..... A42C 5/04 2/171
6,539,556 B1 * 4/2003 Barker ..... A42B 1/062 2/195.1
8,001,624 B1 * 8/2011 Leedom ..... A42B 3/16 2/172
8,533,869 B1 * 9/2013 Capuano ..... A42B 3/12 2/171
8,613,114 B1 * 12/2013 Olivares Velasco ... A42B 3/125 2/171
8,918,918 B2 12/2014 Jackson
2002/0066135 A1 * 6/2002 Tao ..... A42B 3/122 2/411
2004/0034903 A1 * 2/2004 Blair ..... A42B 1/08 2/411
2004/0163162 A1 * 8/2004 Benziger ..... A42B 1/08 2/411
2004/0250340 A1 * 12/2004 Piper ..... A42B 3/064 2/411
2006/0078730 A1 * 4/2006 Tsukada ..... B82Y 30/00 428/364
2006/0162053 A1 * 7/2006 Lee ..... A42B 3/062 2/411
2008/0010721 A1 * 1/2008 Campbell ..... A42B 1/069 2/181.4
2009/0019624 A1 * 1/2009 Birk ..... D02G 3/04 2/455
2010/0107317 A1 * 5/2010 Wang ..... A42B 1/08 2/411
2011/0307997 A1 * 12/2011 Blair ..... A42B 1/08 2/414
2012/0060251 A1 * 3/2012 Schimpf ..... A42B 3/064 2/5
2013/0254978 A1 * 10/2013 McInnis ..... A42B 3/064 2/413
2015/0128332 A1 4/2015 Jinkins

* cited by examiner

SHOCK ABSORBING CAP

CROSS-REFERENCE TO RELATED APPLICATION

The present application claims the benefit of U.S. provisional patent application Ser. No. 62/260,179, filed Nov. 25, 2015, which is hereby incorporated by reference in its entirety.

FIELD OF THE INVENTION

The present invention relates to safety equipment for protecting athletes and others from concussions, and particularly to a shock absorbing cap to be worn by a user inside a hard protective helmet to reduce the transfer of shock from a force impacting the helmet to the head of the athlete or user.

BACKGROUND OF THE INVENTION

Modern helmets used in playing football, riding motor cycles, and etc. have a hard plastic outer shell. Inside there is webbing or relatively hard foam padding connecting the shell to the user's head. When there is a sudden and severe impact on the shell, the shell acts to protect the head from penetrating wounds and scrapes. However, the force is transmitted through the shell to the webbing or padding. Because the webbing or padding is relatively inflexible, they in turn transmit much of the force to the head.

The brain is resting somewhat loosely inside the skull. The sudden force applied to the skull from one direction causes the brain to strike the interior of the skull on the side opposite from where the force was applied. A single such blow can cause a concussion. Repeated strikes, even if not large enough to cause a concussion, are believed to lead to chronic traumatic encephalopathy ("CTE").

US2013/0254978 of McInnis et al. discloses an insert inside a hard plastic shell of a helmet. The insert comprises a shock absorbing portion and a flexible liner portion. The shock absorbing portion is disposed between the helmet shell and the liner portion. The shock absorbing portion has a substantially constant resistive deformation force characteristic for reducing the peak G-force applied to the head during an impact.

The McInnis insert can comprise a plurality of flexible liner connectors for movably interconnecting the liner portion to a helmet shell to allow for the flexible movement of the liner portion relative the shell. The liner connectors can be in the form of vent shaft walls that each defines a vent shaft for providing fluid communication between a head space of the liner and an outer side of the shock absorbing portion to ventilate the space between the wearer's head and the interior of the helmet.

U.S. Pat. No. 8,918,918 of Jackson is basically directed to preventing neck injuries and concussions by using straps to attach a helmet to an anchor assembly at the shoulders, chest and upper back. Similarly, US Published Application No. 2015/0128332 of Jinkins includes shoulder flange straps to prevent the helmet from moving with respect to the shoulders.

SUMMARY OF THE INVENTION

The present invention relates to a structure for providing additional force or shock abortion between the webbing or padding of a traditional safety helmet and the head. This shock absorption is proved by a cap that the user can wear inside the helmet. Thus, there is no need to change the helmets currently in use today. However, a player or motor cycle rider may have to select a slightly larger helmet to accommodate the shock absorbing cap.

The shock absorbing cap is made of three regions of material. The first region, which is next to the scalp, has knitted fiber bundles that extend longitudinally, i.e., from the front forehead to the back of the neck. The fibers of the first region are preferably 100% cotton knitted fibers and act as a ground cap for comfort, good hand and fit close to the scalp. The second region is made of a plurality of layers of braided fiber bundles laid one on top of the other. The fiber bundles of the second layer are preferably made of 100% Wool Fleece. These fiber bundles runs alternately in the longitudinal direction and the lateral direction, i.e., from side to side of the head, and lay on top of each other to practically fill the gap between the first region at the head of the wearer and the interior of the helmet. This second region is the main shock absorbing element of the invention. The final or third region is made of braided fiber bundles of preferably 100% carbon fibers, which run either longitudinally or laterally depending on the direction of the topmost bundle of the second region. The carbon fibers provide great strength to the shock absorbing cap and help it to retain its shape. Further, these fibers tend to spread force applied to one location to the bulk of the cap. Each region is interlocked with the other.

Also, instead of 100% fibers of each type in each region, other fibers may be blended into the bundles so long as most of the fibers in each region are as designated. In addition, the thickness of each region can be adjusted. Most importantly the second region has great resiliency so it can be compressed to absorb a force but return to its original shape after the force is removed. This second region is made with sufficient thickness to absorb most of the force from a typical blow during football or a fall from a moving motor cycle, so as to reduce the chances of a concussion and the likelihood of CTE.

There is a particular process for forming the shock absorbing cap as follows:

1) A Plaster of Paris mold is made of the space between the wearer's head and the interior of the helmet. This is achieved by placing a plastic cap on the user's head which is a replica of the interior of the helmet on the top and is open on the bottom to receive the user's head. Then the Plaster of Paris is poured through an opening in the top and fills the space. As an alternative, the actual helmet can be used as the mold. The plaster is then poured through holes in the helmet. A plastic cap on the users head catches the plaster and forms the base of the mold. The plaster mold can then be measured to get the dimensions required for the shock absorbing cap of the present invention. As an alternative, the mold can be formed from warm wax instead of plaster. Once the void is filled the wax is allowed to cool and solidify. The wax mold is then placed into a container and Plaster of Paris is poured around it. When the plaster is firm, it is heated which melts the wax and allows it to run out (Loss wax molding). What remains is a void in the plaster that is the shape of the void between the user's head and the interior of the helmet. The absorbent cap can then be constructed in this void.

2) The knitted cotton cap is trimmed and applied to the wearer's scalp as if it were a lace front wig.

3) The cap is placed in the void. Then a layer of wool locks, i.e., a braided bundle, is formed. The layer is 3 ply locked and is laid densely on top of the cap in the void in a longitudinal or lateral direction. Then a second layer of wool locks is laid on top of the first and at right angles to it, e.g., laterally if the cotton cap is longitudinal. A third layer with the opposite orientation is laid on the second. This is repeated as the wool lock layers fill up the void. The placement of the layers is adjusted to evenly fill the void, which is not uniform because of the various shapes that a wearer's head can take on.

4) When the void is nearly filled, the third region of carbon fiber material is laid on top of the uppermost layer of wool braid material. The carbon fibers hold the structure together.

5) The cap is removed from the void and is submerged in hot water to cause the various regions and layers to interlock.

BRIEF DESCRIPTION OF THE DRAWINGS

The foregoing and other objects and advantages of the present invention will become more apparent when considered in connection with the following detailed description and appended drawings in which like designations denote like elements in the various views, and wherein.

DETAILED DESCRIPTION OF AN EXEMPLARY EMBODIMENT OF THE INVENTION

Figure 1:
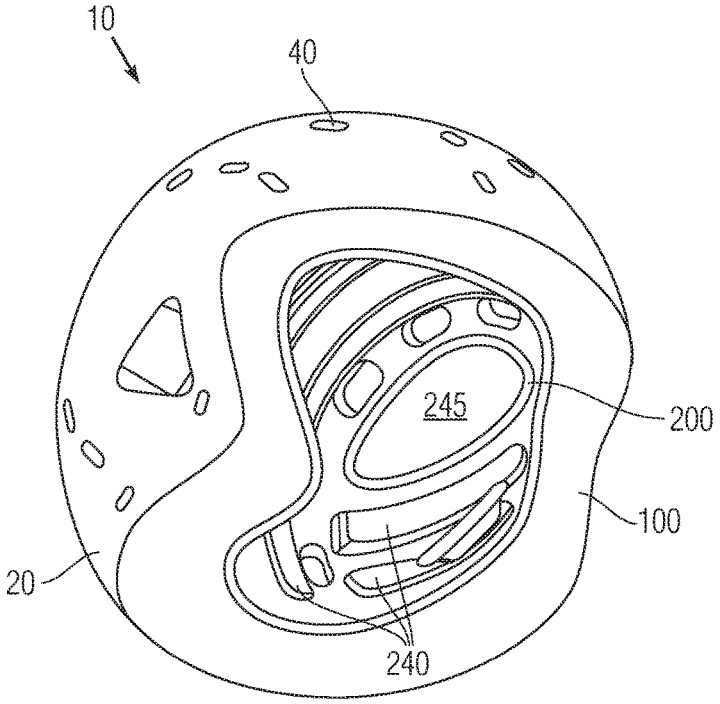
(PRIOR ART) FIG. 1
FIG. 1 illustrates a prior art safety helmet.

FIG. 1 provides a bottom perspective view of a prior art protective helmet designed to reduce concussions from the force of impacts on the head of the wearer. Helmet 10 generally defines a head space and comprises outer shell 20, liner portion 200, and a first shock absorbing portion 100 disposed between the outer shell and the liner portion, all as disclosed in the McInnis publication. The head space is generally adapted for receiving the head of a wearer. First shock absorbing portion 100 is located next to the inner surface of the outer shell 20. Liner portion 200 of the helmet is located at the inner side of the first shock absorbing portion 100.

First shock absorbing portion 100 can be made of, for example, a type of foam, including but not limited to an open-cell sponge foam. It can have a substantially constant resistive deformation force characteristic, i.e., a relatively constant resistive deformation force exhibited during compression. Therefore the resistive deformation force does not significantly increase as the amount of deformation (e.g. compression) increases and may comprise a visco-elastic polyurethane form known as "memory" form. The liner portion 200 can also be made of a closed-cell foam.

Vents 40 can extend from the outer shell through the liner shock absorbing portion 100 and liner 200 to the head of the user. This allows hot air and perspiration to escape from the wearer's head. Further, within the shell spacer elements can be in the form of one or more support ribs 240 and support pads 245, which can be made of any suitable material, including the same material as the material from which liner portion 200 is made.

Figure 2:
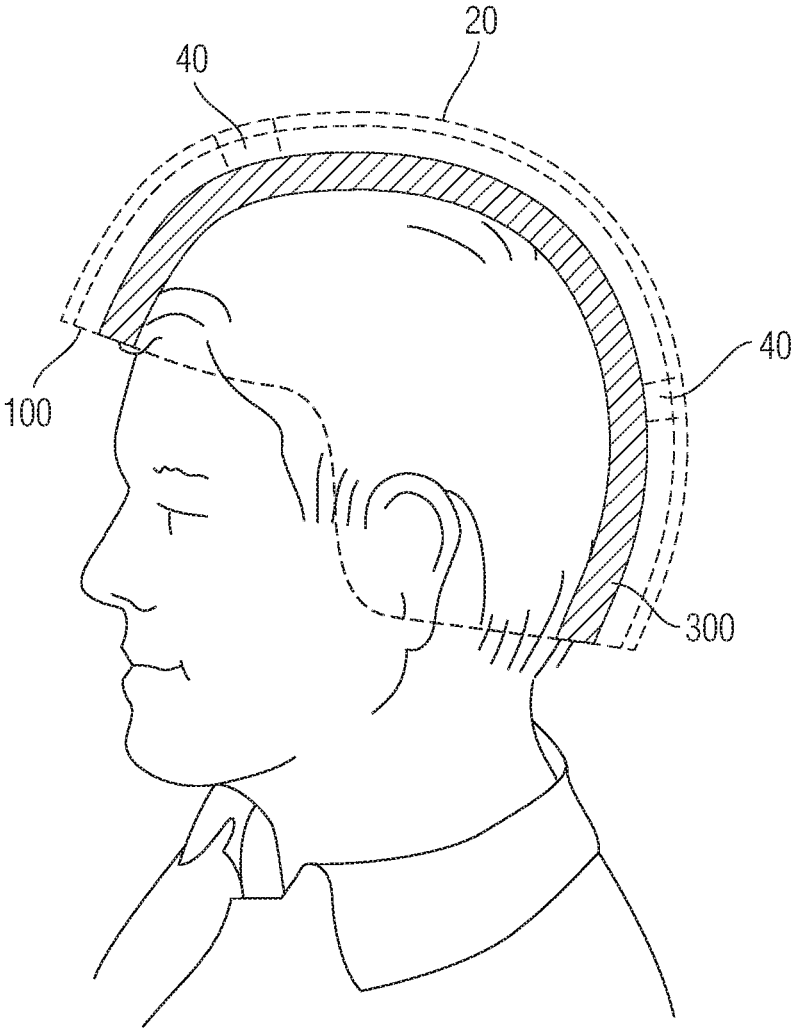
FIG. 2 is a side sectional view of a shock absorbing cap worn under a football helmet according to the present invention.

The present invention is a shock absorbing cap 300 as shown in FIG. 2. It is designed to be worn inside a prior art helmet 10 of any conventional type (shown in dotted line to reveal the cap 300 in FIG. 2.). As in FIG. 1, the helmet in FIG. 2 includes the helmet shell 20 and the first shock absorbing padding 100, which are also shown in dotted line. The present inventor has discovered that the foams and elastomers typically found in the padding of prior art helmets transmit too much of the force to the head of the wearer. As a result, despite the protective helmets of the prior art, athletes and riders of bicycles and motorcycles continue to receive concussions when involved in collisions. When these materials are replaced or augmented with layers of braided wool and carbon strands, the force transmission is greatly reduced and the occurrence of concussions is greatly reduced. As shown in FIG. 2 the cap 300 may be used with a helmet that has padding 100 or that padding can be removed and the cap 300 fills the entire space between the top of the user's head and the interior of the helmet shell 20.

Figure 3:
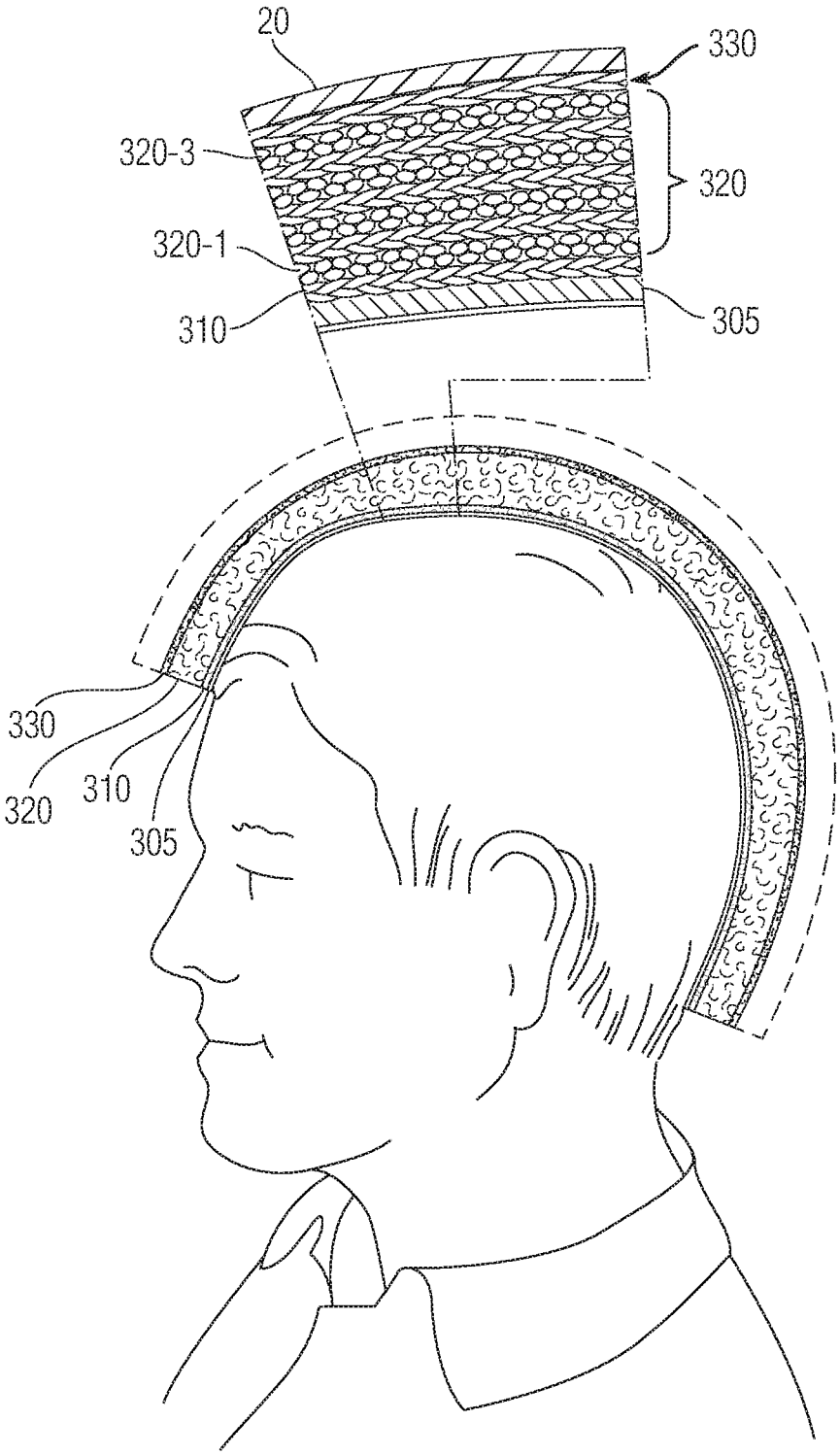
FIG. 3 is a cross sectional view of the details of the shock absorbing cap of FIG. 2

As shown in FIG. 3 the shock absorbing cap is made of three regions of material. The first region 310, which is next to the scalp, has a layer of knitted fiber bundles that extend longitudinally, i.e., from the front forehead to the back of the neck. The fibers of the first region are preferably 100% cotton knitted as a base or ground cap for comfort, good hand and close fit to the scalp.

Figure 4:
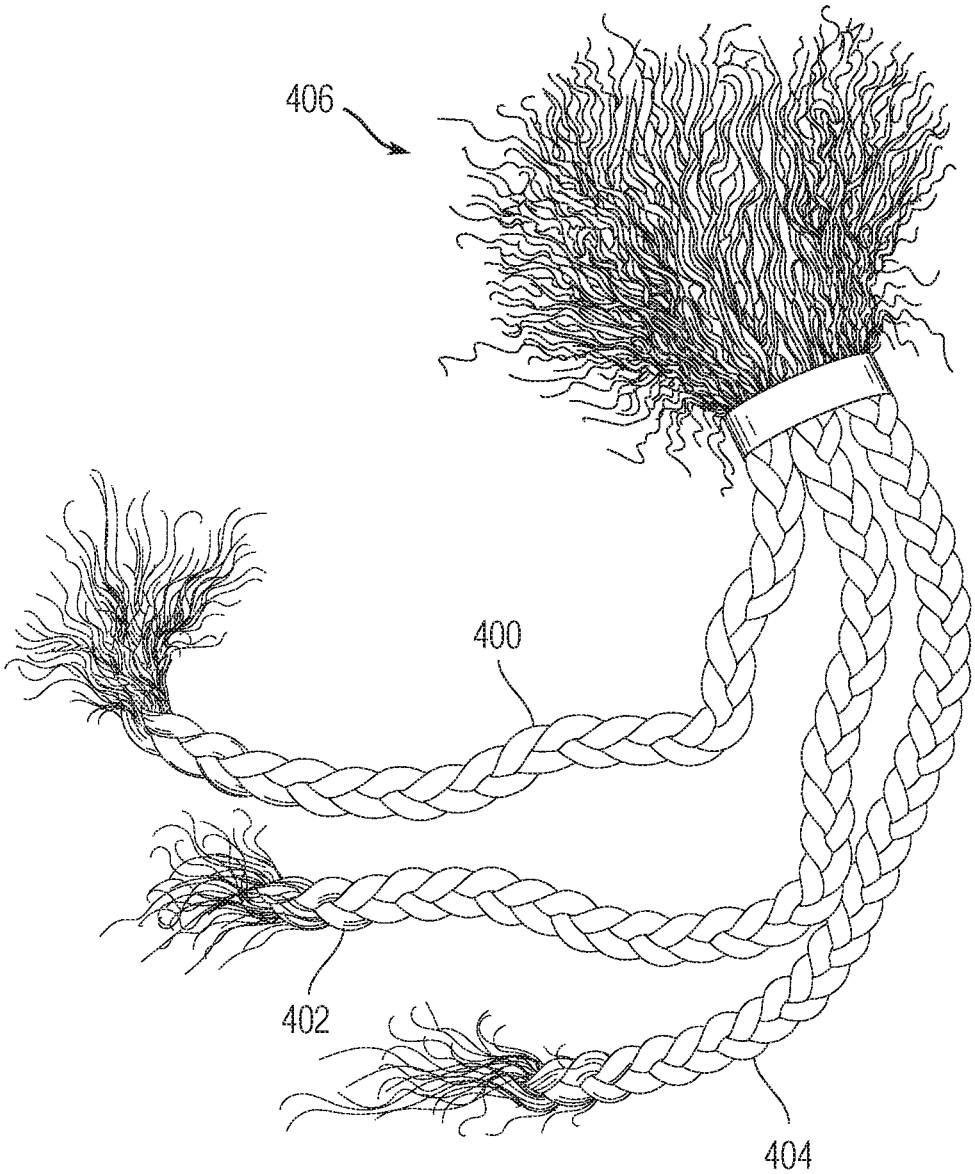
FIG. 4 is a photograph of braided natural Wool Fleece used as a layer in the shock absorbing cap of FIG. 2.

The second region 320 is made up of as many layers of locks made of wool fleece as necessary to generally fill the space between the cotton layer of the first region and the interior of the helmet shell 20 or liner 100. These layers alternate, running laterally, i.e., from side to side of the head, and longitudinally to make up the second region. The first lateral layer 320-1 is shown with the first longitudinal layer 320-1 placed on top of it in FIG. 3. The layers in region 320 are made of braided fiber bundles of preferably 100% Wool Fleece. This region 320 is the main shock absorbing element of the overall cap. FIG. 4 is a drawing of a sample of a single layer of braided Wool Fleece. The various layers of wool in the second region interlock with each other during the manufacturing process. This can be achieved by submerging the structure in hot water. In FIG. 4 there is shown a close up of the crimp in the wool. Three plies of wool are braided to form braids 400, 402, 404. These braids are then twisted or braided together to form a single layer of 9 ply wool 406. This can be continued as necessary to achieve a desired density, e.g., 18 ply or more.

Figure 5:
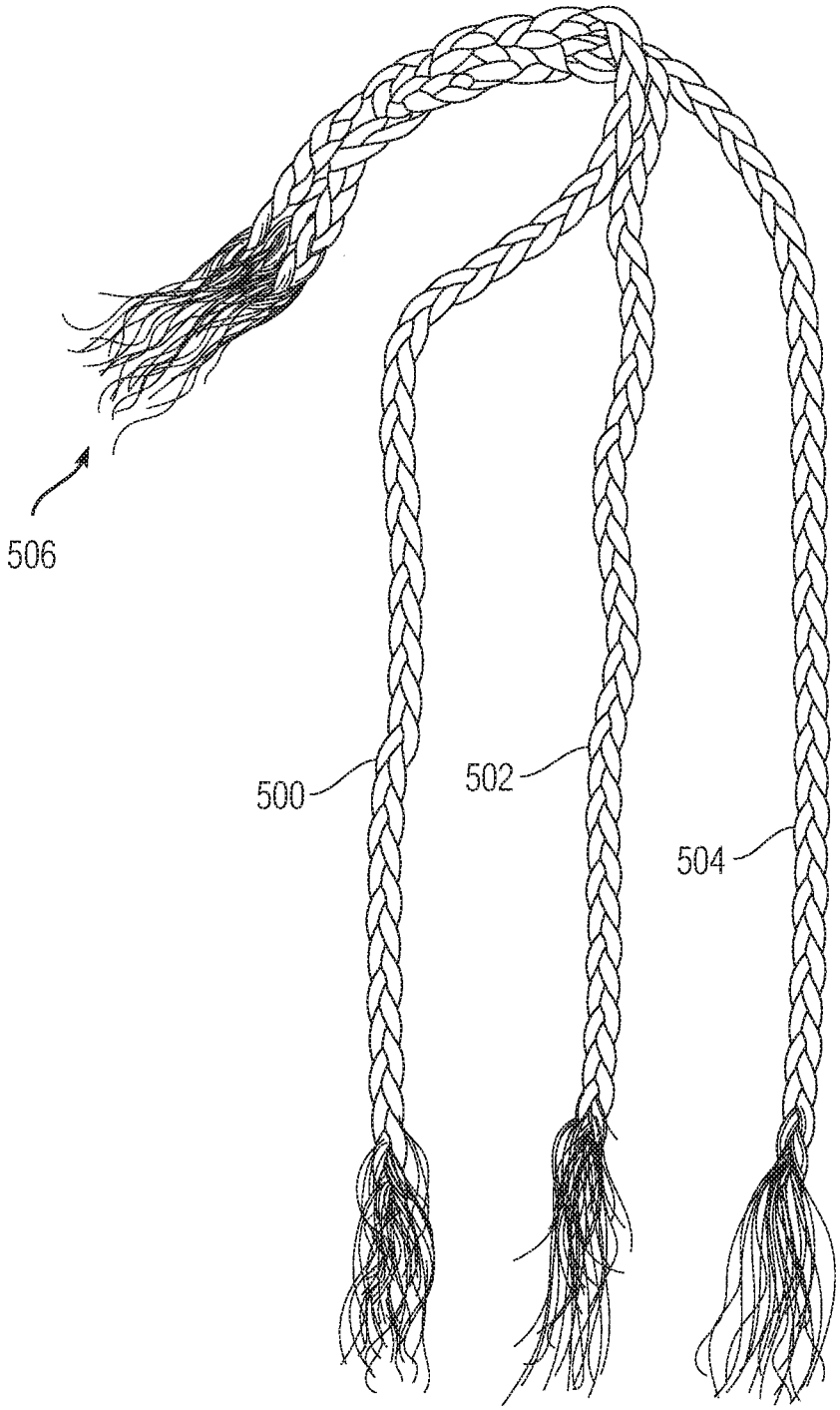
FIG. 5 is a photograph of braided carbon strands used as upper most region of the shock absorbing cap of FIG. 2.

The final or third region 330 is made of a layer of braided fiber bundles of preferably 100% Carbon Fibers, which again run longitudinally or at least in the alternate direction from the top layer 320-3 of the second or wool region as shown in FIG. 3. The Carbon Fibers provide great strength to the shock absorbing cap. Each region 310, 320, 330 is connected with the other, e.g., by sewing. A drawing of a sample of a single layer of braided Carbon Fibers is provided in FIG. 5. In FIG. 5 there is illustrated a three ply lock of carbon fibers tightly braided with other three ply locks to form six ply and so on until it reaches 18 ply or more.

The alternating longitudinal and lateral structure improves the strength of the overall structure, and acts to hold the shape of shock absorbing cap together.

During manufacture the carbon braid can be teased to help it lock. It may be determined in some cases that this carbon braid should have twice the density of the 100% Wool Fleece to add strength. Further, the 100% Wool Fleece has a 13% moisture regain weight (MR factor) and the 100% Cotton Fiber has an 11% moisture regain weight (MR factor), which means that they will absorb that percentage of their weight in water. Both fibers are hydrophilic, have good hand, and a relative quick dry rate. This MR factor is good for the absorbency of sweat and the MR factor of wool also allows for the process of locking the layers together.

The 100% Wool Fleece has a natural bi-component in a 3-D crimp protein structure similar to the molecular structure and natural crimp of African hair. The 100% Wool Fleece has the fiber property of resiliency, which makes it act like a molecular coil. The 100% Carbon Fiber also acts like a molecular coil.

The 100% Carbon fiber is a pyrolysis (meltdown) of the polymers used to make acrylic, nylon and polyester, and it is from this that it derives its strength. The strength of Carbon fibers can mimic the strength of steel. Various numbers of strands of the Carbon fiber can be placed close to the wool, and as the number increases the strength increases.

The material of the present invention provides more shock absorption than the hard rubber, foam and gel substances used in prior art helmets. Also, the prior art gel encased structures can burst or leak as a result of the constant impacts. Despite the increase in shock absorption, the present invention only adds about ½ pound of weight to the player's protective headgear.

There is a particular process for forming the shock absorbing cap. It can be custom made or produced in a variety of common sizes. When making a custom shock absorbing cap the first step is to create a mold solution (e.g., Plaster of Paris) which is used to mold the shape of the space between the various peaks and valleys of the wearer's head and the interior of the helmet. This solution is placed on the user's head; but, the scalp, eyes and ears of the user are covered with a plastic cape.

The mold is formed by placing the helmet or a 3D model of the helmet, on the user's head. This helmet or model of the helmet includes the padding if the cap is to be used to augment that padding. However, if it is to be used to replace the padding, the molding helmet does not have the foam padding of current helmets but is made with little holes to allow the Plaster of Paris mold mixture to be poured into the helmet and be custom fitted to the head. The holes can be especially made or the holes 40 typically used for ventilation of conventional helmets can be used (holes 40 of FIG. 1). In effect the solution for the mold is poured through holes to capture the entire space from the top of the helmet to the scalp of the head mold, even if the shape is irregular when finished.

The helmet is then removed leaving the mold shape, which will allow measurements on all sides, e.g., by using electronic imaging. In particular, measurements can be made of the height of the hair locks, i.e., the distance from the scalp of the head to the top of the helmet. The 100% Wool Fleece and 100% Carbon fiber locks are constructed to follow the dimensions of the mold for both height and width so the shock absorbing cap can be made to fit tightly under the helmet.

As an alternative the actual void can be molded. In this case, instead of Plaster of Paris, a material that is fluid at a low temperature and solid at room temperature, (e.g., wax) is poured into the holes in the helmet. When the wax cools it has the shape of the void. The wax mold is then placed in a container and surrounded with Plaster of Paris. Once the plaster solidifies, it is heated, which causes the wax to melt and run out. This leaves behind a void in the plastic which duplicates the void between the user's head and the interior of the helmet. The shock absorbing cap of the present invention can then be assembled in the void. As necessary, portions of the sides of the mold can be removed to allow easy access to the void for assembly of the cap.

Sheared wool fleece is naturally about two inches in length. For use in the present invention the final length is determined when the wool fleece is aligned to remove natural tangles, and made into wool roving. The Wool roving is braided into seven (7) inch lengths, looped and secured on long smooth tubes where three (3) inches of the looped braiding is clipped. The remaining length is realigned into its original roving then clipped so that both retain their shape.

In an alternative arrangement the wool roving is in a continuous strand. The length will achieve a determined amount of braiding. The braiding is looped over a tube and, clipped. Three (3) inches of the aligned wool roving is left free and is clipped to hold its shape. Then the process is repeated until the end of the wool roving is reached.

The wool is prepared for use in the invention by the steps of washing, scouring and rinsing to remove impurities. While still on the tubes the wool can be immersed into hot water either by being lowered into a bath or having the hot water sprayed onto it from the top of the tube. It is then combed to remove natural tangles, and aligned for braiding. Wool shorn from the sides and top of fully-grown sheep is best. Shearing near the back legs of the sheep is to be avoided to reduce the chance of manure getting in to the wool.

A ground cap is formed by cutting two knitted organic cotton cloths to fit the outline of the scalp and the head. The ground cap is knitted from 100% Cotton Fiber. Cotton cloth is used because of its high absorbency rate, quick drying property, hypoallergenic qualities and comfort. The knitted construction is best for flexibility, stretch, and ultimate fit.

Then the 100% Wool Fleece is braided. However, the bottom portion of the braided wool roving is unbraided to allow for knotting before the remaining portion is secured to the cotton cloth of the ground cap. Next the locks of the wool are sewn densely, securely and individually onto the ground cap. It is suggested that the locked uncut braids be secured individually to the ground cap at the rate of 150% density of the wool compared to the density of cotton knitted ground cap.

The 100% Carbon fibers 330 in FIG. 3 for the top region are prepared for locking by teasing the strands of yarn that will make up the braid. Then the teased Carbon fibers are braided at 18-36 turns/inch, which is the hard twist to torque range. This is achieved by braiding 3 separate plies or strands together to form braids 500, 502, 504 as shown in FIG. 5. These three braids are then twisted together to make a 9 ply braid 506. These can be combined to make an 18 ply layer. However, the number of braids can be increased in order to increase its strength. Teasing of these fibers is optional. The Carbon fibers are attached to the top layer of wool closest to the helmet. They act like a molecular coil to hold the cap together.

The wool region and the carbon fiber region are secured to the cotton ground cap and the assembly is soaked in hot water (preferably spring water free of minerals and other elements). The locking process of the braids begins immediately upon submersion. The size and thickness of the 100% Wool Fleece and 100% Carbon will increase slightly as the locking takes place. No agitation of the water is to take place so as to avoid starting the felting process for the Wool Fleece. Then the structure is removed from the water. At this point it can receive a spritz of water that contains a conditioner to achieve softness. It is then dried. For example, it can be run through a stuffer box and subjected to bulk texturizing to achieve final controlled locking. It should be noted that this more labor-intensive application may prove to be optional. Overall the diameter of the locks does not allow the usual crochet application into a wig cap.

As a final step a second knitted 100% Cotton Fiber cap or fourth region with at Least one fourth layer 305 is provided. (FIG. 3) The fourth layer is padded with about ½ inch 100% cotton scrim, securely sewn to the interior of the main cotton ground cap 310 at a layer closest to the user's scalp. This padding prevents the threads of the ground cap 310 from being exposed, thus preventing them from irritating the scalp of the user. With this cap a lace may be used, i.e., a web attached with glue following the natural outline of the front of the head such as that used to attach a wig. The lace front application can take place after the padding is applied.

Optionally, a rolled sustainable or all natural fiber covering for a highly resilient man-made spandex fiber may be required for fit. If Spandex is used it must be core spun in polyester achieving both strength and elasticity.

When the shock absorbing cap of the present invention is not to be used for a while, e.g., during the off-season for football, it can be cared for and renovated by the owner if refurbishing is not needed. For example it can be soaked in a hypoallergenic shampoo, rinsed thoroughly, soaked in a conditioner, and rinsed thoroughly again, before allowing it to thoroughly air dry.

The product of the present invention is a stand-alone product that can be customized to any head size and head shape, and can be made to fit comfortably under any protective helmet. However, a less expensive product for mass appeal can simply be made in a number of average sizes and shapes. While the fit will not be as good with such a standard product, it will still be good enough to reduce significantly the chances of concussion.

To determine maximum comfort for the standard shock absorbing cap of the present invention, the head of a sport participant is measured around the circumference, across the center of the top of the head from ear to ear, from the back of the neck up to the center top of the scalp, and to the line of the scalp all around the head. These measurements correspond to certain standard shapes so the user can select the proper one. While the weight and height of the shock absorbing cap will vary from player to player—men's and women's head sizes will vary, a close enough fit can be achieved without the necessity to form a mold of the particular user's head.

For future cost consideration other fibers may be blended into the bundles so long as these fibers offer similar functionality as the 100% fibers described herein. In addition, the thickness of each layer can be adjusted. Most importantly the middle or wool region must have great resiliency so it can be compressed to absorb a force but return to its original shape after the force is removed. This middle or wool region is made with sufficient thickness to absorb most of the force from a typical blow during a football game or a fall from a moving bicycle or motorcycle.

While the shock absorbing cap of the present invention can be made in various sizes to fit the head of the wearer, an elastic band can be included around the base of the shock absorbing cap to securely hold it on the head of the wearer. Ultimately the shock absorbing cap is designed to fit comfortably on the user's head and under the helmet.

While the shock absorbing cap of the present invention is designed primarily for professional football players where the problem of CTE has been identified, it can also be a preventive solution for the millions of non-professional and/or educational team members in the sport of football. The shock absorbing cap can also act as a protective device for use in various other sports and for bicycles and motor cycle riders.

While the present invention has been particularly shown and described with reference to preferred embodiments thereof; it will be understood by those skilled in the art that various changes in form and details may be made therein without departing from the spirit and scope of the invention.

What I claimed is:

1. A cap that is configured to provide force or shock absorption between an interior of a safety helmet and a head of a wearer, comprising: a first region, which is configured to be positioned near the head of the wearer, the first region being formed as a first region cap, said first region being made from at least a first layer of knitted fiber bundles that are adapted to extend either longitudinally or laterally of the wearer's head, said first region being substantially made of cotton fibers; a second region attached to the first region cap, said second region being made of a plurality of second layers of braided fiber bundles laid together so as to interlock with each other, said plurality of second layers of braided fiber bundles being substantially made of wool fleece, said braided fiber bundles comprising braided plies forming a plurality of braids that are subsequently braided or twisted, wherein at least one layer of said plurality of second layers of braided fiber bundles comprises first braids of the plurality of braids, the first braids being aligned in one of a longitudinal direction and a lateral direction, and wherein at least one other layer of said plurality of second layers comprises second braids of the plurality of braids, the second braids being aligned in the other of the longitudinal direction and the lateral direction, and wherein the at least one layer is positioned on top of the at least one other layer such that each layer of plurality of second layers has braided fiber bundles adapted to extend alternately either longitudinally or laterally of the wearer's head; a third region attached to an uppermost layer of the plurality of second layers of the second region, the third region being positioned to form an outermost region of the cap such that said third region is adapted to engage the interior of the helmet, said third region being made of at least a third layer of additional braided fiber bundles that are adapted to run either longitudinally or laterally of the wearer's head, said at least a third layer of fiber bundles being substantially made of carbon fibers, wherein said plurality of second layers of braided fiber bundles fill the space between the first region cap and the third region; and a fourth region adapted to fit between the first region cap and the head of the wearer, said fourth region being formed as a fourth layer made from a padded scrim to prevent exposed threads of the at least a first layer from contacting the head of the wearer.

2. The cap of claim 1 wherein the at least a first layer of knitted fiber bundles is made of 100% cotton fibers.

3. The cap of claim 1 wherein the plurality of second layers of braided fiber bundles is made of 100% wool fleece.

4. The cap of claim 1 wherein the at least a third layer of additional braided fiber bundles is made of 100% carbon fibers.

5. The cap of claim 1 wherein the fourth layer is made of knitted 100% cotton fibers.

6. The cap of claim 1 wherein the plurality of second layers in the second region is capable of providing cushioning of the wearer's head against impacts on the helmet and is arranged such that the plurality of second layers is capable of compensating for distance variations between the wearer's head and the interior of the helmet.

7. The cap of claim 1 wherein braided fiber bundles of a lowermost layer of the plurality of second layers of the second region extend in a direction orthogonal to the knitted fiber bundles of the at least a first layer of the first region and the additional braided fiber bundles of the at least a third layer of the third region extend in a direction orthogonal to braided fiber bundles of the uppermost layer of plurality of second layers of the second region.

* * * * *